United States Patent [19]

Severson et al.

[11] Patent Number: 4,613,735

[45] Date of Patent: Sep. 23, 1986

[54] TUBULAR SWITCH PACKAGE WITH SLIDING CONTACTS FORMING A PORTION THEREOF

[75] Inventors: Gerald R. Severson; Richard C. Wade, both of Scottsdale, Ariz.

[73] Assignee: Motorola, Inc., Schaumburg, Ill.

[21] Appl. No.: 750,574

[22] Filed: Jul. 1, 1985

[51] Int. Cl.[4] ..... H01H 19/14; H01B 3/40

[52] U.S. Cl. ..... 200/158; 200/153 S; 200/336

[58] Field of Search ..... 200/153 S, 158, 155 A, 200/16 B, 51.14, 336

[56] References Cited

U.S. PATENT DOCUMENTS 2,755,364 7/1956 Parker ..... 200/158
2,851,551 9/1958 Lambert ..... 200/51.14
2,896,040 7/1959 Jensen ..... 200/248

FOREIGN PATENT DOCUMENTS 2113472 8/1983 United Kingdom ..... 200/265

*Primary Examiner*—Stephen Marcus
*Assistant Examiner*—Renee S. Luebke
*Attorney, Agent, or Firm*—Eugene A. Parsons

[57] ABSTRACT

A switch including an elongated tubular base member having a plurality of ring shaped insulators and conductors alternately mounted thereon and having threads formed in the outer surface thereof. A switching control ring having mating threads in the inner surface thereof and a conducting surface in sliding engagement with the outer surface of the ring shaped insulators and conductors so that switching action occurs as the control ring is moved axially along the structure. The elongated tubular base member operates as a housing to receive electronic circuitry therein, which circuitry may be sealed so that the assembled apparatus provides external switching for the internal circuitry of a hermetically sealed unit.

11 Claims, 3 Drawing Figures

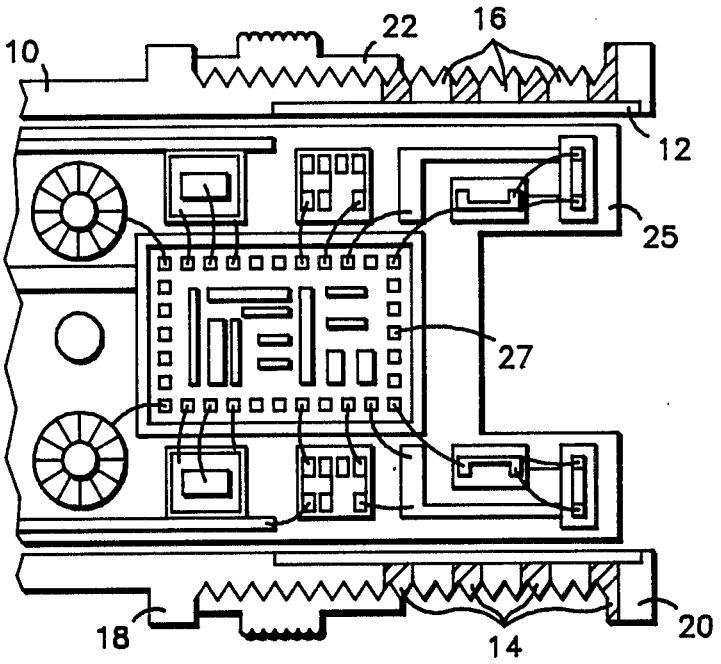
FIG. 1
FIG. 2
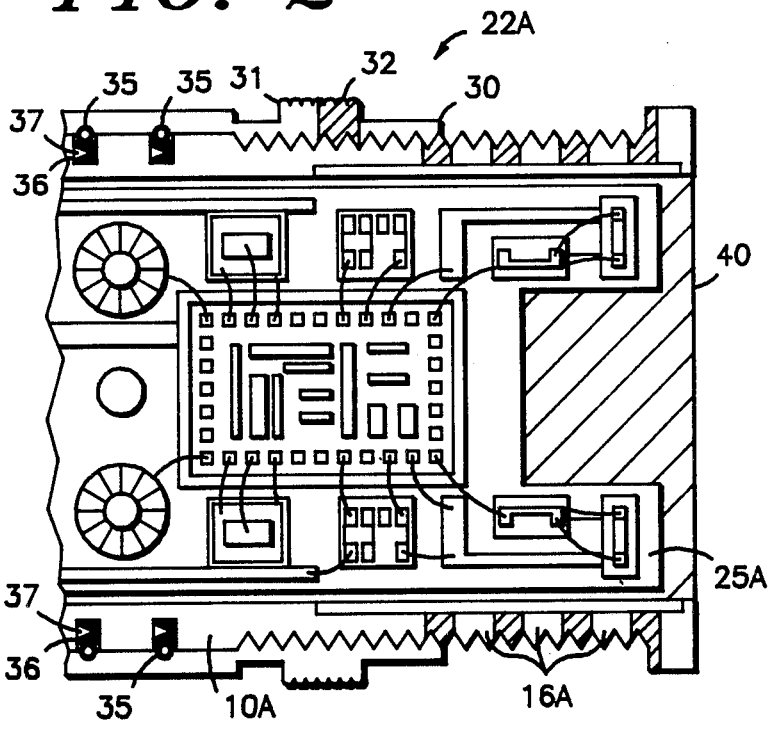

TUBULAR SWITCH PACKAGE WITH SLIDING CONTACTS FORMING A PORTION THEREOF

BACKGROUND OF THE INVENTION

The present invention pertains to a switch package wherein the switch assembly is designed to accommodate electrical and/or mechanical devices within the confines of the assembly. Specifically, internal circuitry can be hermetically sealed within the switch with the switch assembly providing external switching for the internal circuitry.

No switching devices designed to accommodate an electrical or mechanical device within the confines of the switching device are known.

SUMMARY OF THE INVENTION

The present invention pertains to a switch package including an elongated tubular member having a plurality of electrically conductive surface portions insulated from each other and a tubular control member mounted coaxial with said elongated tubular member and including at least one surface contact portion in relative sliding engagement with the electrically conductive and non-conductive surface portions of the elongated tubular member so that the control member is moveable between a plurality of positions wherein various ones of the conductive surface portions may be connected to the surface contact portion or connected to each other through the surface contact portion. The elongated tubular member defines a central volume adapted to receive electronic components fixedly mounted therein, which electronic components may be sealed, hermetically or otherwise, and electrically connected to the conductive surface portions and, or the surface contact portion so that external switching for the internal circuitry is provided.

It is an object of the present invention to provide a new and improved switch package.

It is a further object of the present invention to provide a new and improved switch package wherein external switching for internal circuitry sealed within the housing of the switch is provided.

It is a further object of the present invention to provide a relatively simple and inexpensive switch package.

These and other objects of this invention will become apparent to those skilled in the art upon consideration of the accompanying specification, claims and drawings.

BRIEF DESCRIPTION OF THE DRAWINGS

Referring to the drawings,

FIG. 1 is a view in cross section, portions thereof broken away, illustrating a switch package embodying the present invention;

FIG. 2 is a view similar to FIG. 1 of another embodiment of the present invention.

DESCRIPTION OF THE PREFERRED EMBODIMENTS

Figure 3:
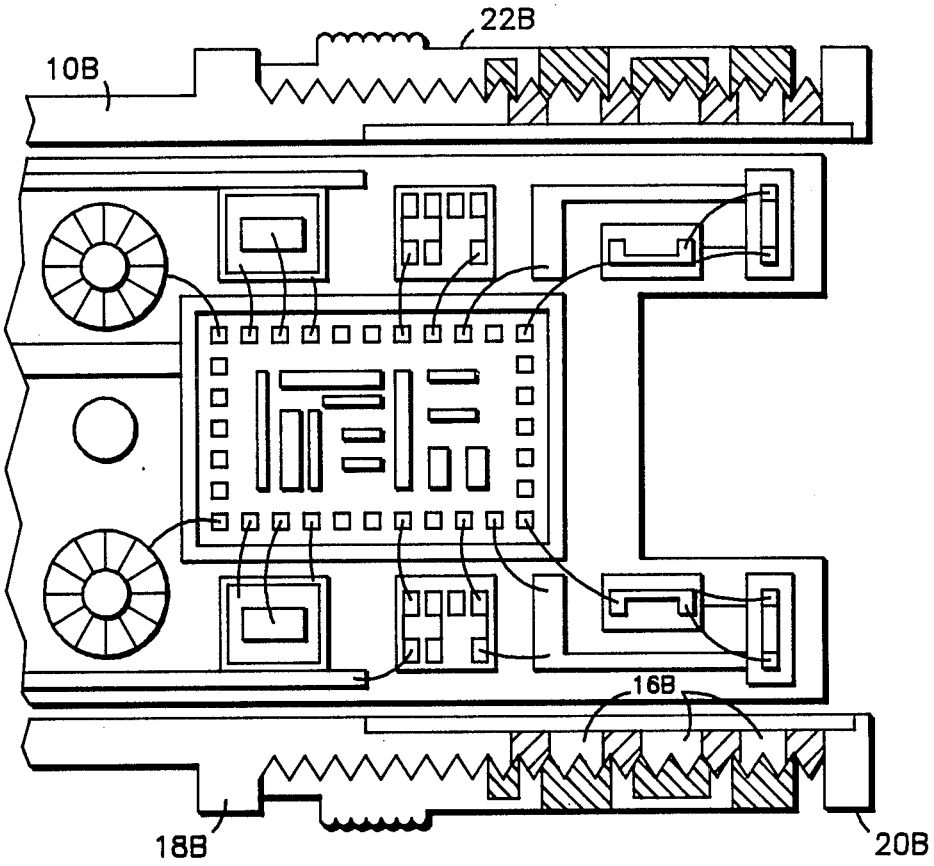
FIG. 3 is a view similar to FIG. 1 of another embodiment of the present invention.

Referring specifically to FIG. 1, the mechanical body of the switch includes an elongated tubular base member 10 with an anodized metal support sleeve 12 engaged therewith to provide a substantially continuous, smooth inner wall. The sleeve 12 may be formed as an integral part of the base member 10 or may be affixed thereto by some means, such as press fitting, welding, etc. A plurality of ring shaped insulators 14 and a plurality of ring shaped conductors 16 are alternately positioned, coaxially over the sleeve 12 to provide a laminated structure of alternate conducting and non-conducting sections. The sleeve 12 is formed of an anodized metal or the like so that the ring shaped conductors 16 are not shorted together. Thus, each of the ring shaped conductors 16 is insulated from the switch body and from the adjacent conductors.

The outer circumference of the ring shaped insulator 14, the ring shaped conductor 16, and a portion of the base member 10 is threaded so as to provide a continuous thread extending axially along the assembly. A radially outwardly extending shoulder 18 is formed integrally with base member 10 at one end of the threaded portion and a second radially outwardly extending shoulder 20 is affixed to the opposite end of sleeve 12. Shoulders 18 and 20 provide stops at opposite ends of the threaded portion of the assembly.

A switching control ring 22 having threads in the inner surface thereof is mated with the threads in the outer surface of the assembly for axial movement therealong in response to rotary movement of switching control ring 22 relative to base member 10. In this particular embodiment control ring 22 is formed of electrically conductive material so that it makes electrical contact with the outer surface of ring shaped conductors 16 as it moves axially along base member 10. As shown in FIG. 1, switching control ring 22 is against stop 18 and is not in contact with any of the ring shaped conductors 16.

The central volume defined by tubular base member 10, including sleeve 12, is adapted to receive electronic components, and/or mechanical components, fixedly mounted therein. In the embodiment illustrated in FIG. 1 a printed wiring board 25 is positioned within the volume, which printed wiring board includes a semiconductor chip 27 and other associated electrical components. Ring shaped conductors 16 each include a radially inwardly directed insulated lead (not shown) which extends through an opening in sleeve 12 and is connected appropriately to printed wiring board 25. In this particular embodiment base member 10 is a reference potential, ground, and also has a lead (not shown) extending radially inwardly into electrical contact with printed wiring board 25. As control ring 22 is rotated to move it axially to the right in FIG. 1, toward shoulder 20, each ring shaped conductor 16 is slidingly engaged by control ring 22 and, therefore, is connected to ground. If control ring 22 is moved into abutting engagement with shoulder 20, the 3 ring shaped conductors 16 are all electrically connected together but are not grounded. In this embodiment shoulders 18 and 20 operate as movement limiting devices to prevent further movement of control ring 22.

Referring specifically to FIG. 2, a second embodiment of the invention is illustrated, which embodiment is similar to that illustrated in FIG. 1, except for a control ring, generally designated 22A. Other components which are similar to components illustrated in FIG. 1 are designated with a similar number and an "A" is added to indicate a second embodiment. Control ring 22A is formed with two conducting portions 30 and 31, separated by a ring shaped insulator 32. The three portions of control ring 22A may be laminated together, or held in abutting engagement by some other means. In this particular embodiment when control ring 22A is in the extreme right-hand position, conducting portion 30 connects the first two ring shaped conductors 16*a* together and connects the left ring shaped conductor 16A to base member 10A. Several other possible intermediate connections are available, e.g. the first two (from the left) ring shaped conductors 16A may be connected to each other.

In the embodiment of FIG. 2, a plurality of balls 35 are positioned in openings 36 in base member 10A and spring biased, by compression spring 37, outwardly into engagement with control ring 22A. A plurality of mating detents are formed in control ring 22A to engage balls 35 when control ring 22A is correctly positioned for the desired interconnections between ring shaped conductors 16A. It will of course be understood that a plurality of different positions for control ring 22A might be provided and separate detents for each of the various positions will operate to lock control ring 22A in the desired position.

In FIG. 2, the printed wiring board 25A and the components thereon are sealed into the central opening by means of a potting or sealing compound 40. The internal circuitry mounted within the central volume is completely sealed by filling the central volume with the potting material 40 and this may actually be a hermetic seal. In this particular embodiment control ring 22A provides external switching for the internal circuitry without requiring externally accessible contacts or leads which in many instances are difficult to hermetically seal.

Referring specifically to FIG. 3, a third embodiment of the present invention is illustrated wherein components similar to those illustratd in FIG. 1 are designated with a similar number and the letter B is added to denote the third embodiment. In this embodiment the stops 18B and 20B are utilized but the switching control ring 22B is extended to the right to completely cover all of the ring shaped conductors 16B. In this specific embodiment control ring 22B has a plurality of interconnected conducting portions with inner surfaces positioned to slidingly engage the inner surfaces of ring shaped conductors 16B when control ring 22B is moved to the right against stop 20B. Further, because of the extended length of control ring 22B, the control ring only has to be rotated approximately one turn to move it from its extreme left-hand position to its extreme right-hand position. In FIG. 3 control ring 22B is illustrated in its extreme left-hand position and none of the conducting portions are in contact with ring shaped conductors 16B. When control ring 22B is moved to the extreme right-hand position the two right-hand ring shaped conductors 16B are connected together and the left-hand ring shaped conductor 16B is connected to base member 10B. In this particular embodiment the contacts are covered by control ring 22B to reduce corrosion and the entry of foreign material. It will of course be understood that the contact areas can be reduced in size, and/or a coarser thread can be utilized so that control ring 22B is rotated a minimum amount to provide the switching action. Further, while threads are illustrated is the various embodiments to provide sliding engagement between the ring shaped conductors and the control ring, it will be understood by those skilled in the art that a simple axial movement might be utilized if desired. Further, the axially spaced ring shaped conductors may be replaced with circumferentially displaced axially extending contacts, if desired. However, the specific embodiments shown are preferred because of the simplicity of manufacture and consequent low expense.

While we have shown and described several specific embodiments of the present invention, further modifications and improvements will occur to those skilled in the art. We desire it to be understood, therefore, that this invention is not limited to the particular forms shown and we intend in the appended claims to cover all modifications which do not depart from the spirit and scope of this invention.

What is claimed is:

1. A switch package comprising:

an elongated tubular base member;

a plurality of ring shaped conductors;

a plurality of ring shaped insulators, said ring shaped conductors and insulators being mounted in coaxial overlying relationship with said base member and, further, being alternately positioned in abutting engagement to provide a substantially continuous tubular sleeve over the outer surface of said base member, said tubular sleeve having an outer surface formed of alternate conducting and insulating sections;

a switching control ring having at least a portion of an inner surface thereof formed of conducting material and mounted coaxially in overlying relationship with said tubular sleeve, the inner surface of said control ring being positioned in sliding engagement with the outer surface of said tubular sleeve; and means for providing axial movement of said switching ring along said tubular sleeve and for maintaining said switching ring in a desired axial position.

2. A switch package as claimed in claim 1 wherein the means for providing axial movement includes threads formed in the outer surface of the tubular sleeve and matching threads formed in the inner surface of the switching control ring.

3. A switch package as claimed in claim 2 wherein the means for providing axial movement further includes locking means.

4. A switch package as claimed in claim 1 wherein the tubular sleeve includes an electrical connection to each of the ring shaped conductors, said connections being accessible from inside the base member.

5. A switch package as claimed in claim 4 having in addition electronic circuitry mounted within the tubular base member and connected to the electrical connections.

6. A switch package as claimed in claim 5 wherein the electronic circuitry and electrical connections thereto are sealed within the tubular base member.

7. A switch package comprising:

an elongated tubular member having a plurality of electrically conductive surface portions insulated from each other by electrically nonconducting portions;

a tubular control member having a surface contact portion of electrically conductive material, said control member being mounted coaxial with said elongated tubular member in relative sliding engagement and moveable relative to said elongated tubular member between a first position in which the surface contact portion is in sliding engagement with no more than one of the conductive surface portions of said elongated tubular member and a second position in which the surface contact portion is in sliding engagement with at least two of the conductive surface portions of said elongated tubular member; and said elongated tubular member and said tubular control member cooperating to define a central volume adapted to receive electronics components fixedly mounted therein.

8. A switch package as claimed in claim 7 wherein the elongated tubular member is formed at least partially of alternate nonconductive and conductive rings fixedly attached together to provide the electrically conductive surface portions.

9. A switch package as claimed in claim 7 wherein the relative sliding engagement between the elongated tubular member and the tubular control member is provided by matching threaded surfaces on the elongated tubular member and the tubular control member.

10. a switch package comprising:

an elongated tubular member having a plurality of electrically conductive surface portions insulated from each other by electrically nonconducting portions;

a tubular control member having at least one surface contact portion of electrically conductive material, said control member being mounted coaxial with said elongated tubular member in relative sliding engagement and moveable relative to said elongated tubular member between a plurality of positions in which at least one surface contact portion of the tubular control member is in sliding engagement with different ones of the conductive surface portions of said elongated tubular member to provide a switching action in each of the plurality of positions; and said elongated tubular member and said tubular control member cooperating to define a central volume adapted to receive electronics components fixedly mounted therein.

11. A switch package as claimed in claim 10 wherein the tubular control member has a plurality of surface contact portions separated from each other by insulating material and positioned to each slidingly engage different surface portions of the elongated tubular member different predetermined relative positions between the tubular control member and the elongated tubular member.

* * * * *